US006987426B2

(12) United States Patent
Komai et al.

(10) Patent No.: US 6,987,426 B2
(45) Date of Patent: Jan. 17, 2006

(54) NONRECIPROCAL CIRCUIT ELEMENT WITH INPUT AND OUTPUT CHARACTERISTIC IMPEDANCES MATCHED

(75) Inventors: Eiichi Komai, Niigata-ken (JP); Hitoshi Onishi, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 68 days.

(21) Appl. No.: 10/823,922

(22) Filed: Apr. 14, 2004

(65) Prior Publication Data

US 2004/0207480 A1 Oct. 21, 2004

(30) Foreign Application Priority Data

Apr. 16, 2003 (JP) ..... 2003-111913

(51) Int. Cl.
*H01P 1/383* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,365,827 B1 * 4/2002 Schuchinsky et al. ..... 174/33
2004/0160288 A1 * 8/2004 Shibayama ..... 333/24.2

FOREIGN PATENT DOCUMENTS

JP 2000-151217 5/2000

* cited by examiner

*Primary Examiner*—Stephen E. Jones
(74) *Attorney, Agent, or Firm*—Brinks Hofer Gilson & Lione

(57) ABSTRACT

A nonreciprocal circuit element includes a magnetic plate, a common electrode on a first surface of the magnetic plate, and first, second, and third central conductors each including a pair of divisions. The three central conductors extend from the common electrode, are bent along the magnetic plate towards a second surface of the magnetic plate, and cross one another on the second surface of the magnetic plate at a predetermined angle relative to one another. The first and second central conductors are connected to input and output terminals. The nonreciprocal circuit element satisfies the relationship $\theta_1>\theta_2$, where $\theta_1$ is the angle between the divisions of the first central conductor and $\theta_2$ is the angle between the divisions of the second central conductor, when the first central conductor is farther away from the magnetic plate than the second central conductor.

2 Claims, 9 Drawing Sheets

NONRECIPROCAL CIRCUIT ELEMENT WITH INPUT AND OUTPUT CHARACTERISTIC IMPEDANCES MATCHED

This application claims the benefit of priority to Japanese Patent Application No. 2003-111913, herein incorporated by reference.

BACKGROUND OF THE INVENTION

1. Field of the Invention

The present invention relates to a nonreciprocal circuit element, particularly to a nonreciprocal circuit element capable of matching the input and output characteristic impedances.

2. Description of the Related Art

A lumped-constant nonreciprocal circuit element (isolator) is a high-frequency component for allowing a signal to pass in the transmission direction without loss while blocking a signal traveling in the reverse direction. It is typically used in a transmission circuit of a mobile communication apparatus such as a mobile phone. A known example of such an isolator is described in Japanese Unexamined Patent Application Publication No. 2000-151217.

The isolator described in the Japanese Unexamined Patent Application Publication No. 2000-151217 includes three pairs of central conductors, the three pairs crossing one another at an angle of about 120° relative to one another and being insulated from one another. In this isolator, the two conductors of each pair are not parallel to each other. With this structure, the isolator exhibits wideband electrical characteristics and isolation characteristics in a desired frequency band.

In general, in order to reduce the insertion loss of an isolator, the characteristic impedances of at least two central conductors connected to the input and output terminals of the isolator are preferably matched.

In the isolator described in the Japanese Unexamined Patent Application Publication No. 2000-151217, however, one of the two central conductors connected to the input and output terminals is disposed off the ferrite at their intersection. This means that one of the two central conductors is farther away from the shield plate (common electrode) than the other, the shield plate being disposed on a surface of the ferrite remote from the surface where the central conductors are disposed. Due to this difference between the two central conductors in distance to the ferrite, the characteristic impedances of the central conductors become mismatched, thus the insertion loss increases, and accordingly the transmission efficiency of a signal decreases.

One possible approach for matching the characteristic impedances of two central conductors is to make the width of one central conductor shorter than that of the other. Unfortunately, reducing the width of a central conductor makes the conductor mechanically weak. This is disadvantageous in the production of central conductors.

SUMMARY OF THE INVENTION

Accordingly, an object of the present invention is to provide a nonreciprocal circuit element that is made superior in transmission efficiency by suppressing insertion loss without reducing the width of central conductors.

According to an aspect of the present invention, a nonreciprocal circuit element includes an input terminal, an output terminal, a magnetic plate, and a common electrode disposed on a first surface of the magnetic plate. The nonreciprocal circuit element further includes a first central conductor, a second central conductor, and a third central conductor, each including a pair of divisions. The three central conductors extend from the circumference of the common electrode in three different directions and are bent along the circumference of the magnetic plate towards a second surface of the magnetic plate so as to cross one another on the second surface of the magnetic plate at a predetermined angle relative to one another. The first and second central conductors are connected to the input and output terminals. In this nonreciprocal circuit element, the relationship $\theta_1>\theta_2$ is satisfied, where $\theta_1$ is the angle between the pair of divisions of the first central conductor and $\theta_2$ is the angle between the pair of divisions of the second central conductor, when the first central conductor is farther away from the magnetic plate than the second central conductor.

In the present invention, an angle between a pair of divisions is defined as an angle between two imaginary center lines crossing each other, the two imaginary center lines corresponding to the pair of divisions, respectively.

An imaginary center line of a division is defined as a line connecting the centers in the width direction at both extremities of the division so as to extend along the longitudinal direction of the division.

An extremity of a division is defined as a longitudinal end of the segment of the division, i.e., the segment overlapping the second surface of the magnetic plate.

According to the nonreciprocal circuit element of the present invention, the characteristic impedances of the first and second central conductors connected to the input and output terminals can be matched by satisfying the relationship $\theta_1>\theta_2$, where $\theta_1$ and $\theta_2$ are as defined above. The insertion loss of the nonreciprocal circuit element can be reduced by matching the above-described characteristic impedances, and thereby the signal transmission efficiency can be improved.

The characteristic impedance of a central conductor increases as the angle between its divisions becomes larger. On the other hand, the characteristic impedance of a central conductor decreases as the distance between the central conductor and the opposing common electrode increases, the distance being defined by the thickness of the magnet plate.

In the present invention, the first central conductor which has a longer distance from the magnetic plate than the second central conductor is compensated for a decrease in characteristic impedance by making the angle between the divisions of the first central conductor larger than the angle between the divisions of the second central conductor. As a result of this compensation, the characteristic impedances of the first and second central conductors that are connected to the input and output terminals can be matched.

Furthermore, the characteristic impedances of the first and second central conductors can be matched only by adjusting $\theta_1$ and $\theta_2$. This eliminates the need to reduce the width of divisions of the central conductors. This advantageously retains the mechanical strength of the divisions, and therefore the nonreciprocal circuit element can easily be produced.

In the nonreciprocal circuit element according to the present invention, the angle $\theta_2$ is preferably 0°. This means that the divisions of the second central conductor are parallel to each other.

In order to match the characteristic impedances of the first and second central conductors, it is sufficient to adjust the angle between the divisions of the first central conductor if the divisions of the second central conductor are set parallel to each other.

DESCRIPTION OF THE PREFERRED EMBODIMENTS

First Embodiment

Figure 1:
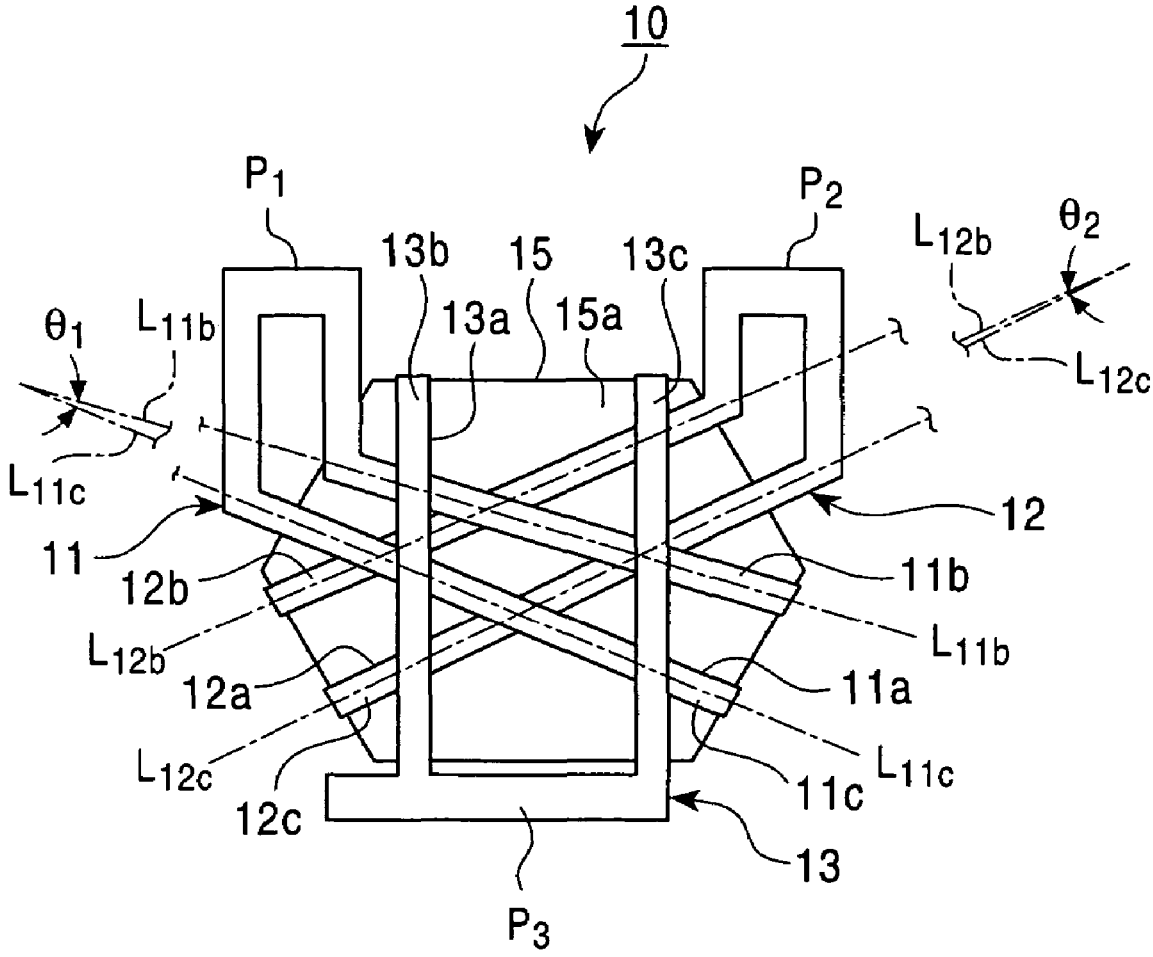
FIG. 1 is a schematic plan view showing the main section of an isolator as an example of a nonreciprocal circuit element according to a first embodiment of the present invention.
Figure 2:
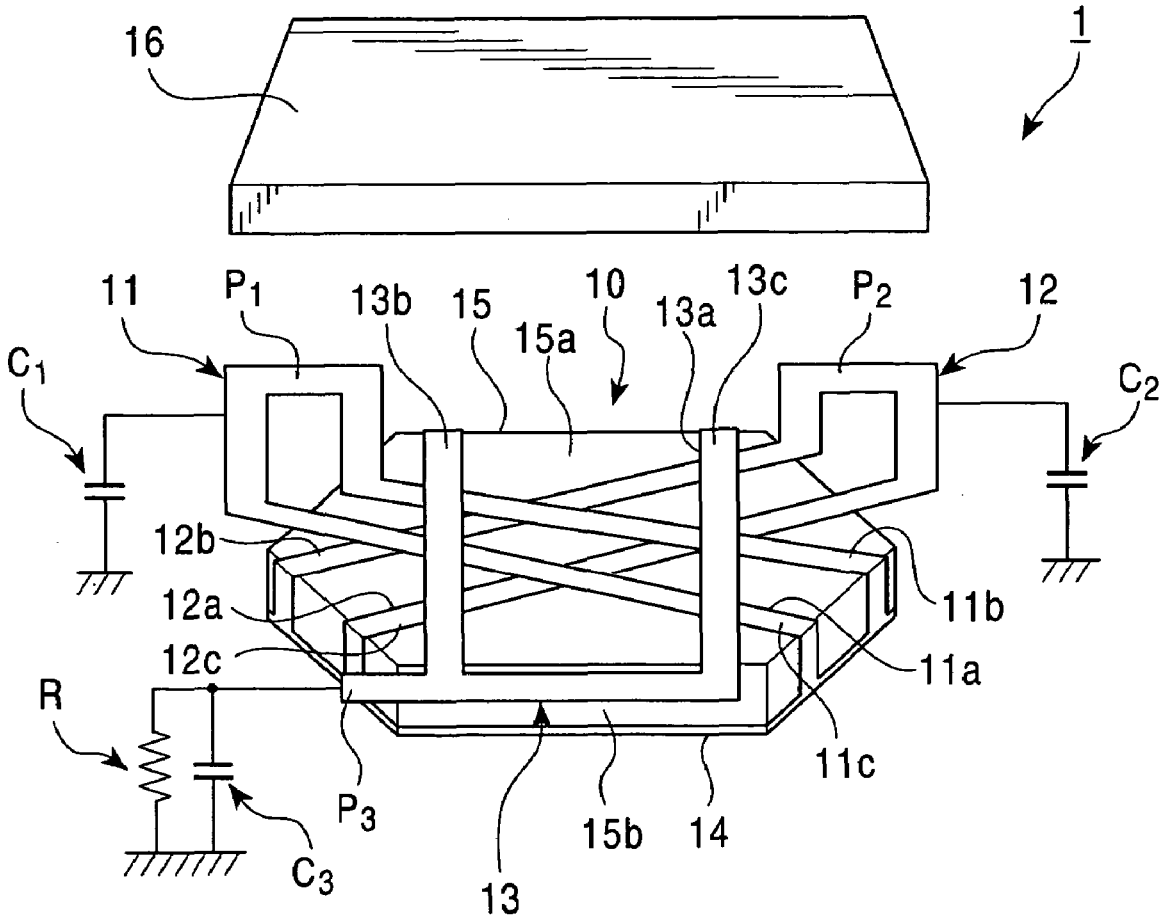
FIG. 2 is a schematic perspective view showing the main section of an isolator as an example of a nonreciprocal circuit element according to a first embodiment of the present invention.
Figure 3:
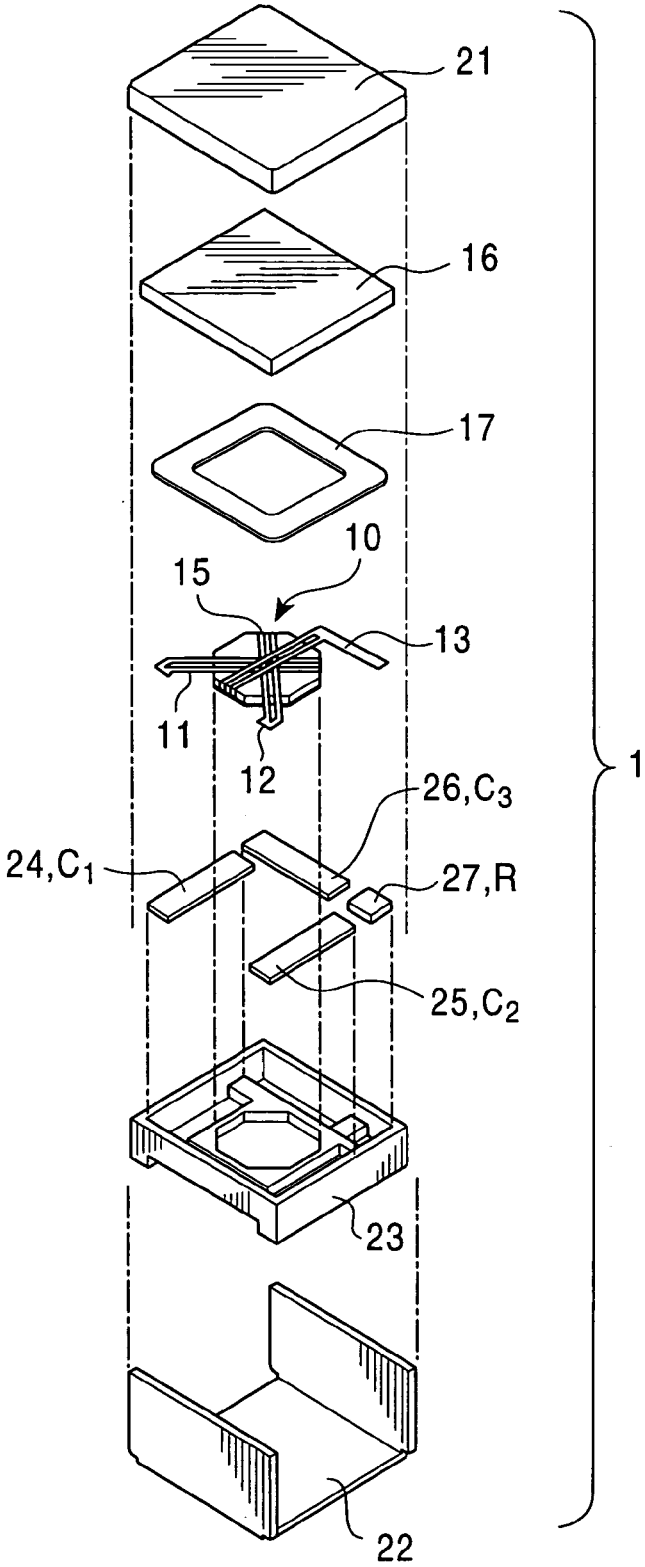
FIG. 3 is an exploded perspective view showing an isolator as an example of a nonreciprocal circuit element according to a first embodiment of the present invention.

A first embodiment according to the present invention will now be described with reference to the attached drawings. FIG. 1 is a schematic plan view showing the main section of an isolator as an example of a nonreciprocal circuit element according to the present invention. FIG. 2 is a perspective view of the main section of the isolator. FIG. 3 is an exploded perspective view of the isolator.

Referring to FIGS. 1 and 2, an isolator 1 according to this embodiment includes a magnetic assembly 10 and a permanent magnet 16 as major components. The magnetic assembly 10 includes a flat magnetic plate 15 made of ferrite; a common electrode 14 in the form of a metal plate provided on a bottom surface (a first surface) 15*b* of the magnetic plate 15; and first, second, and third central conductors 11, 12, and 13. Each of the three central conductors 11, 12, and 13 extends radially in a different direction from the common electrode 14 and is bent along the magnetic plate 15 towards a top surface (a second surface) 15*a* of the magnetic plate 15.

On the top surface 15*a*, the three central conductors 11, 12, and 13 cross one another at a predetermined angle relative to one another, one overlapping another. Although not shown in the figures, the central conductors 11, 12, and 13 are insulated from one another by an insulating sheet on the top surface 15*a* of the magnetic plate 15.

The positional relationship among the central conductors 11, 12, and 13 is described with reference to FIG. 1. The second central conductor 12 is disposed closest to the magnetic plate 15, the first central conductor 11 is disposed on the second central conductor 12, and the third central conductor 13 is disposed on the first central conductor 11. In other words, the first central conductor 11 is farther away from the magnetic plate 15 than the second central conductor 12. If this positional relationship between the first central conductor 11 and the second central conductor 12 is satisfied, the third central conductor 13 may be disposed on the first central conductor 11, as shown in FIGS. 1 and 2, or may be disposed closest to the magnetic plate 15.

Referring to FIGS. 1 and 2, the ends of the central conductors 11, 12, and 13 are provided with ports $P_1$, $P_2$, and $P_3$, respectively, such that the ports $P_1$, $P_2$, and $P_3$ protrude from the magnetic plate 15. Matching capacitors $C_1$ and $C_2$ are connected to the ports $P_1$ and $P_2$, respectively. A capacitor $C_3$ and a terminating resistor (resistor element) R are connected to the port $P_3$. The magnetic assembly 10 including these electrical components and the permanent magnet 16 are disposed in a magnetic yoke functioning as a magnetic circuit. In this manner, the isolator 1 is constructed where the permanent magnet 16 applies a DC magnetic field to the magnetic assembly 10.

In the isolator 1, the port $P_1$ and the port $P_2$ are connected to an input terminal and an output terminal, respectively, of the isolator 1. Thus, the first central conductor 11 and the second central conductor 12 are connected to the input and output terminals, respectively.

As shown in FIGS. 1 and 2, the central conductors 11 to 13 are integrally connected to one another at the common electrode 14 functioning as a grounding portion and extend from the common electrode 14 in three different directions. The central conductors 11 to 13 are accurately disposed at a predetermined angle relative to the magnetic plate 15, and are bent towards the top surface 15*a* of the magnetic plate 15 so as to face the common electrode 14 disposed on the remote bottom surface 15*b* of the highly dielectric magnetic plate 15. In this state, the central conductors 11 to 13 function as microstrip lines.

Referring to FIGS. 1 and 2, the first central conductor 11, the second central conductor 12, and the third central conductor 13 are provided with a slit 11*a*, a slit 12*a*, and a slit 13*a*, respectively. Each of the three central conductors 11 to 13 includes two conductor divisions generated by the corresponding slit. More specifically, the first central conductor 11 includes a division 11*b* and a division 11*c*, the second central conductor 12 includes a division 12*b* and a division 12*c*, and the third central conductor 13 includes a division 13*b* and a division 13*c*. The divisions 11*b*, 11*c*, 12*b*, 12*c*, 13*b*, and 13*c* are substantially linear conductors extending, with a constant width maintained, along the longitudinal direction of the respective central conductors 11, 12, and 13.

As shown in FIG. 1, the divisions 11*b* and 11*c* of the first central conductor 11 extend such that the slit 11*a* between the divisions 11*b* and 11*c* becomes narrower from the common electrode 14 towards the port $P_1$. In other words, an imaginary center line $L_{11b}$, which is a longitudinal center line of the division 11*b*, and an imaginary center line $L_{11c}$, which is a longitudinal center line of the division 11*c*, are not parallel to each other. Hence, the imaginary center lines $L_{11b}$ and $L_{11c}$ cross each other at an angle $\theta_1$. In the present invention, $\theta_1$ is defined as an angle between the divisions 11*b* and 11*c*.

The imaginary center line $L_{11b}$ is defined as a line connecting the centers in the width direction at both extremities of the division 11*b* so as to extend along the longitudinal direction of the division 11*b*. The imaginary center line $L_{11c}$ is defined in the same manner in relation to the division 11*c*. From a different viewpoint, the imaginary center lines $L_{11b}$ and $L_{11c}$ divide the divisions 11*b* and 11*c*, respectively, into two equal subdivisions, because segments of the divisions 11*b* and 11*c* according to this embodiment, i.e., the segments overlapping the top surface 15*a* of the magnetic plate 15, are substantially linear conductors extending, with a constant width maintained, along the longitudinal direction of the respective central conductors 11 and 12.

Similarly, the divisions 12*b* and 12*c* extend such that the slit 12*a* between the divisions 12*b* and 12*c* becomes narrower from the common electrode 14 towards the port $P_2$. In other words, an imaginary center line $L_{12b}$, which is a longitudinal center line of the division 12*b*, and an imaginary center line $L_{12c}$, which is a longitudinal center line of the division 12*c*, are not parallel to each other. Hence, the imaginary center lines $L_{12b}$ and $L_{12c}$ cross each other at an angle $\theta_2$. In the present invention, $\theta_2$ is defined as an angle between the divisions 12*b* and 12*c*. Consequently, similarly with the divisions 11*b* and 11*c*, the imaginary center lines $L_{12b}$ and $L_{12c}$ divide the divisions 12*b* and 12*c*, respectively, into two equal subdivisions.

On the other hand, the divisions 13*b* and 13*c* of the third central conductor 13 extend parallel to each other.

According to this embodiment, $\theta_2$ for the second central conductor 12 and $\theta_1$ for the first central conductor 11, which overlaps the second central conductor 12 and is farther away from the magnetic plate 15 than the second central conductor 12, are determined so as to satisfy the relationship $\theta_1>\theta_2$.

The angle $\theta_1$ preferably ranges from 2° to 10°, and more preferably from 4° to 6°. The angle $\theta_2$ preferably ranges from 0° to 4°, and more preferably from 0° to 2°.

In general, the characteristic impedance of a central conductor decreases as the distance between the central conductor and an opposing common electrode (e.g., common electrode 14) increases, the distance being defined by the thickness of a magnet plate (e.g., magnetic plate 15). In this embodiment, the first central conductor 11 has a longer distance from the magnetic plate 15 than the second central conductor 12. So far as the characteristic impedance affected by the above-described distance is concerned, therefore, the first central conductor 11 has a smaller measurement than the second central conductor 12.

On the other hand, the characteristic impedance of a central conductor increases as the angle between its divisions (e.g., divisions 11*b* and 11*c*) becomes larger. In this embodiment, it follows from the relationship $\theta_1>\theta_2$ that, for the characteristic impedance affected by the above-described angle, the first central conductor 11 has a larger measurement than the second central conductor 12.

Consequently, in this embodiment, the first central conductor 11, which has a longer distance from the magnetic plate 15 than the second central conductor 12, is compensated for a decrease in characteristic impedance by making $\theta_1$ larger than $\theta_2$, where $\theta_1$ is the angle between the divisions 11*b* and 11*c* as defined above, and $\theta_2$ is the angle between the divisions 12*b* and 12*c* as defined above. As a result of this compensation, the characteristic impedances of the central conductors 11 and 12 that are connected to the input and output terminals can be matched. To make the characteristic impedances match each other, $\theta_1$ and $\theta_2$ are adjusted.

Although the divisions 13*b* and 13*c* of the third central conductor 13 are parallel to each other in this embodiment, the divisions 13*b* and 13*c* may be formed such that the slit 13*a* between the division 13*b* and 13*c* becomes narrower from the common electrode 14 towards the port $P_3$, as with the central conductors 11 and 12, or may be formed such that the slit 13*a* becomes wider from the common electrode 14 to a halfway point and then narrower from the halfway point towards the port $P_3$. Furthermore, the slit 13*a* may extend straight to a halfway point and then becomes narrower from the halfway point towards the port $P_3$.

Regarding the respective capacitances $Cap_1$ and $Cap_2$ of the matching capacitors $C_1$ and $C_2$ connected to the central conductors 11 and 12, the capacitance $Cap_1$ may be larger than or equal to the capacitance $Cap_2$. The capacitance $Cap_3$ of the capacitor $C_3$ connected to the third central conductor 13 may be equal to either the capacitance $Cap_1$ or the capacitance $Cap_2$ or may be different from the capacitances $Cap_1$ and $Cap_2$.

If the capacitance $Cap_1$ is larger than the capacitance $Cap_2$, the center frequency for the reflection coefficient in the first central conductor 11 can be made to match that in the second central conductor 12. This advantageously reduces insertion loss, and thereby increases the transmission efficiency of a signal.

Referring to FIG. 3, the isolator 1 includes a closed magnetic circuit (magnetic yoke) composed of a top yoke component 21 and a bottom yoke component 22. A resin casing 23 is disposed between the top yoke component 21 and the bottom yoke component 22. The resin casing 23 contains the rectangular permanent magnet 16, a spacer 17, the magnetic assembly 10, capacitor plates 24, 25, and 26 ($C_1$, $C_2$, and $C_3$), and a terminating resister 27 (R). The magnetic assembly 10 includes the magnetic plate 15 and the first, second, and third central conductors 11, 12, and 13 wound around the magnetic plate 15. The capacitor plate 24 is disposed on the first central conductor 11, the capacitor plate 25 is disposed on the second central conductor 12, and the capacitor 26 and the terminating resister 27 are disposed on the third central conductor 13.

The plate capacitors 24, 25, and 26 include the capacitors $C_1$, $C_2$, and $C_3$, respectively. The terminating resister 27 includes the terminating resistor element R.

Figure 4:
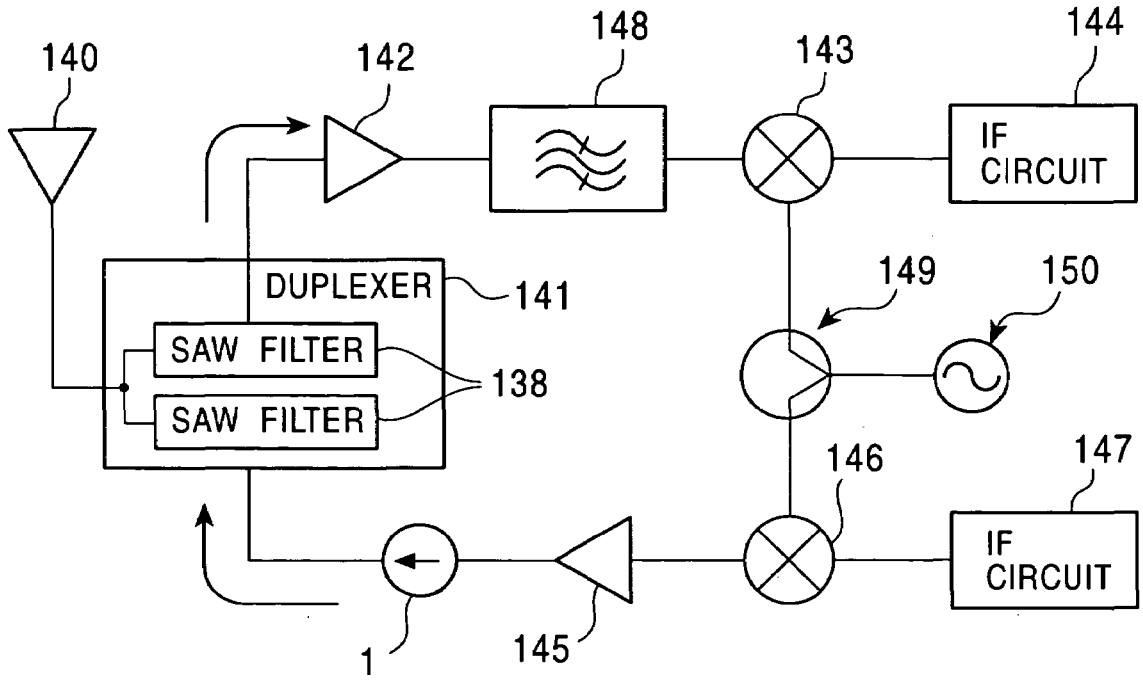
FIG. 4 is an example of a circuit of a mobile phone including an isolator according to a first embodiment.

FIG. 4 is an example of a circuit of a mobile phone including the isolator 1 according to this embodiment. In this circuit, a duplexer 141 is connected to an aerial 140; an intermediate frequency (IF) circuit 144 is connected to an output of the duplexer 141 via a low-noise amplifier 142, an inter-stage filter 148, and a mixer 143; an IF circuit 147 is connected to an input of the duplexer 141 via the isolator 1, a power amplifier 145, and a mixer 146; and a local oscillator 150 is connected to the mixers 143 and 146 via a distributing transformer 149.

The duplexer 141 includes, for example, two ladder SAW filters 138. The input terminal of each of the ladder SAW filters 138 is connected to the aerial 140, the output terminal of one ladder SAW filter 138 is connected to the low-noise amplifier 142, and the output terminal of the other ladder SAW filter 138 is connected to the isolator 1.

The isolator 1 described above, which is used in a circuit of a mobile phone, allows signals from the isolator 1 to the duplexer 141 to pass at low insertion loss, but causes high insertion loss with signals from the duplexer 141 to the isolator 1 to block such signals in that direction. Thus, the isolator 1 prevents undesired signals such as noise in the duplexer 141 from entering the power amplifier 145 in the reverse direction.

Second Embodiment

Figure 5:
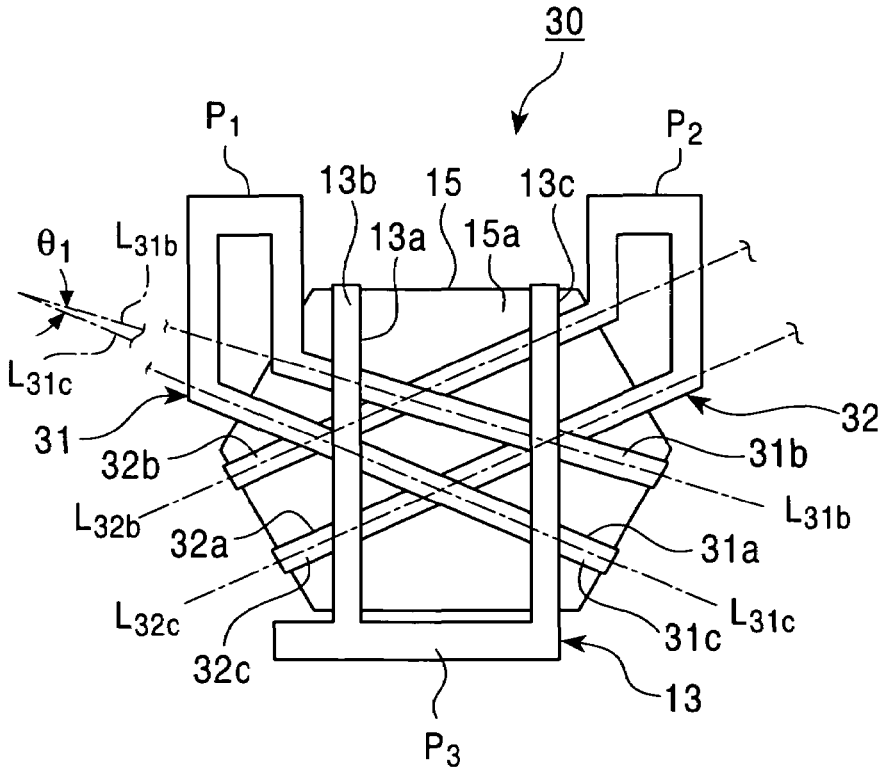
FIG. 5 is a schematic plan view showing the main section of an isolator as an example of a nonreciprocal circuit element according to a second embodiment of the present invention.

A second embodiment of the present invention will now be described with reference to the drawings. FIG. 5 is a schematic plan view of the main section of an isolator according to this embodiment. In this embodiment, the angle $\theta_2$ between the two divisions of a second central conductor is 0°. The reference numerals and symbols in FIG. 5 refer to the same components as those with the same reference numerals and symbols in FIG. 1, and repeated descriptions of the same components are omitted or provided only briefly.

Referring to FIG. 5, a magnetic assembly 30 of an isolator according to this embodiment includes a magnetic plate 15; a common electrode (not shown) disposed on the bottom surface of the magnetic plate 15; and first, second, and third central conductors 31, 32, and 13 protruding in three directions from the common electrode and being wrapped towards a top surface 15*a* of the magnetic plate 15.

The positional relationship among the three central conductors at their intersection is as with the first embodiment. That is, the first central conductor 31 is farther away from the magnetic plate 15 than the second central conductor 32.

As shown in FIG. 5, the first central conductor 31, the second central conductor 32, and the third central conductor 13 are provided with a slit 31*a*, a slit 32*a*, and a slit 13*a*, respectively. Each of the three central conductors 31, 32, and 13 includes two conductor divisions generated by the corresponding slit. More specifically, the first central conductor 31 includes two divisions 31*b* and 31*c*, the second central conductor 32 includes two divisions 32*b* and 32*c*, and the third central conductor 13 includes two divisions 13*b* and 13*c*. The divisions 31*b*, 31*c*, 32*b*, 32*c*, 13*b*, and 13*c* are substantially linear conductors extending, with a constant width maintained, along the longitudinal direction of the respective central conductors 31, 32, and 13.

As shown in FIG. 5, the divisions 31*b* and 31*c* of the first central conductor 31 extend such that the slit 31*a* between the divisions 31*b* and 31*c* becomes narrower from the common electrode towards the port $P_1$. In other words, an imaginary center line $L_{31b}$, which is a longitudinal center line of the division 31*b*, and an imaginary center line $L_{31c}$, which is a longitudinal center line of the division 31*c*, are not parallel to each other. Hence, the imaginary center lines $L_{31b}$ and $L_{31c}$ cross each other at an angle $\theta_1$.

In contrast, the divisions 32*b* and 32*c* extend such that the width of the slit 32*a* between the divisions 32*b* and 32*c* is constant from the common electrode towards the port $P_2$. In other words, an imaginary center line $L_{32b}$, which is a longitudinal center line of the division 32*b*, and an imaginary center line $L_{32c}$, which is a longitudinal center line of the division 32*c*, are parallel to each other. Hence, the imaginary center lines $L_{32b}$ and $L_{32c}$ do not cross each other, that is, $\theta_2$ is 0° in this embodiment of the present invention.

As a result, in this embodiment, the relationship between $\theta_1$ for the first central conductor 31 and $\theta_2$ for the second central conductor 32 is represented by $\theta_1>\theta_2=0°$.

Here, the angle $\theta_1$ preferably ranges from 2° to 10°, and more preferably from 4° to 6°.

In the isolator with the structure described above, as with the first embodiment, the characteristic impedances of the first and second central conductors 31 and 32 connected to the input and output terminals can be matched.

In this embodiment, since the divisions 32*b* and 32*c* of the second central conductor 32 are parallel to each other, it is sufficient to adjust only $\theta_1$, i.e., the angle between the divisions 31*b* and 31*c* of the first central conductor 31, for characteristic impedance adjustment.

Third Embodiment

Figure 6:
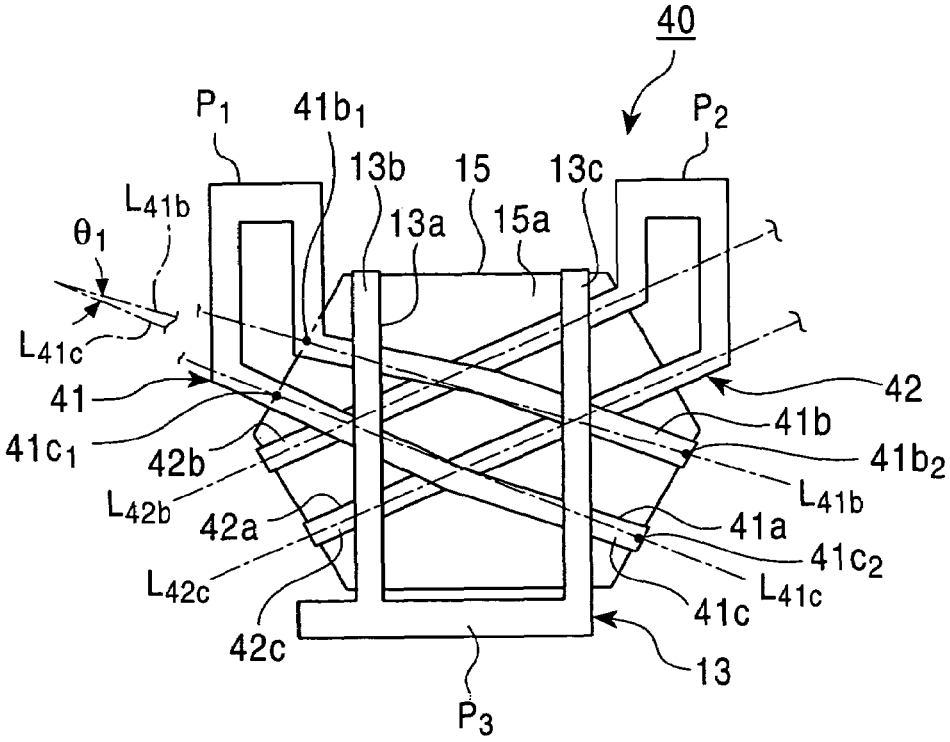
FIG. 6 is a schematic plan view showing the main section of an isolator as an example of a nonreciprocal circuit element according to a third embodiment of the present invention.

A third embodiment of the present invention will now be described with reference to the drawings. FIG. 6 is a schematic plan view of the main section of an isolator according to this embodiment. In this embodiment, the two divisions of a first central conductor are parallel to each other from the common electrode to a halfway point and extend so as to converge from the halfway point towards the port, and the angle $\theta_2$ between the two divisions of a second central conductor is 0°. The reference numerals and symbols in FIG. 6 refer to the same components as those with the same reference numerals and symbols in FIG. 1, and repeated descriptions of the same components are omitted or provided only briefly.

Referring to FIG. 6, a magnetic assembly 40 of an isolator according to this embodiment includes a magnetic plate 15; a common electrode (not shown) disposed on the bottom surface of the magnetic plate 15; and first, second, and third central conductors 41, 42, and 13 protruding in three directions from the common electrode and being wrapped towards a top surface 15*a* of the magnetic plate 15.

The positional relationship among the three central conductors at their intersection is as with the first embodiment. That is, the first central conductor 41 is farther away from the magnetic plate 15 than the second central conductor 42.

As shown in FIG. 6, the first central conductor 41, the second central conductor 42, and the third central conductor 13 are provided with a slit 41*a*, a slit 42*a*, and a slit 13*a*, respectively. Each of the three central conductors 41, 42, and 13 includes two conductor divisions generated by the corresponding slit. More specifically, the first central conductor 41 includes two divisions 41*b* and 41*c*, the second central conductor 42 includes two divisions 42*b* and 42*c*, and the third central conductor 13 includes two divisions 13*b* and 13*c*. The divisions 41*b*, 41*c*, 42*b*, 42*c*, 13*b*, and 13*c* are substantially linear conductors extending, with a constant width maintained, along the longitudinal direction of the respective central conductors 41, 42, and 13.

As shown in FIG. 6, the divisions 41*b* and 41*c* of the first central conductor 41 on the top surface 15*a* of the magnetic plate 15 extend in parallel to each other from the common electrode to a halfway point and, from the halfway point, the divisions 41*b* and 41*c* extend such that the slit 41*a* between the divisions 41*b* and 41*c* becomes narrower towards the port $P_1$. In other words, an imaginary center line $L_{41b}$ for the division 41*b* and an imaginary center line $L_{41c}$ for the division 41*c* are not parallel to each other. Hence, the imaginary center lines $L_{41b}$ and $L_{41c}$ cross each other at an angle $\theta_1$.

The imaginary center line $L_{41b}$ is defined as a line connecting the centers in the width direction at both extremities of the division 41*b* so as to extend along the longitudinal direction of the division 41*b*. The imaginary center line $L_{41c}$ is defined in the same manner in relation to the division 41*c*. Here, an extremity of a division of a central conductor is defined as a longitudinal end of the segment of the division, i.e., the segment overlapping the top surface 15*a* of the magnetic plate 15. In short, the imaginary center lines $L_{41b}$ and $L_{41c}$ are as shown in FIG. 6, where the divisions 41*b* and 41*c* according to this embodiment are substantially linear conductors with a constant width along the longitudinal direction, and extend in parallel to each other up to a halfway point and, from the halfway point extend so as to converge towards the port 1.

As a result, the imaginary center line $L_{41b}$ is defined as a line connecting points 41$b_1$ and 41$b_2$, as shown in FIG. 6, where the points 41$b_1$ and 41$b_2$ are respectively the centers in the width direction at both longitudinal extremities of the division 41*b*. The imaginary center line $L_{41c}$ is defined as a line connecting points 41$c_1$ and 41$c_2$ in the same manner in relation to the division 41*c*.

In contrast, the divisions 42*b* and 42*c* extend such that the width of the slit 42*a* between the divisions 42*b* and 42*c* is constant from the common electrode towards the port $P_2$. In other words, an imaginary center line $L_{42b}$, which is a longitudinal center line of the division 42*b*, and an imaginary center line $L_{42c}$, which is a longitudinal center line of the division 42*c*, are parallel to each other. Hence, the imaginary center lines $L_{42b}$ and $L_{42c}$ do not cross each other, that is, $\theta_2$ is 0° in this embodiment of the present invention.

As a result, in this embodiment, the relationship between $\theta_1$ for the first central conductor 41 and $\theta_2$ for the second central conductor 42 is represented by $\theta_1>\theta_2=0°$.

Here, the angle $\theta_1$ preferably ranges from 2° to 10°, and more preferably from 4° to 6°.

In the isolator with the structure described above, as with the first embodiment, the characteristic impedances of the first and second central conductors 41 and 42 connected to the input and output terminals can be matched.

In this embodiment, since the divisions 42*b* and 42*c* of the second central conductor 42 are parallel to each other, it is sufficient to adjust only $\theta_1$, i.e., the angle between the divisions 41*b* and 41*c* of the first central conductor 41, for characteristic impedance adjustment.

Fourth Embodiment

Figure 7:
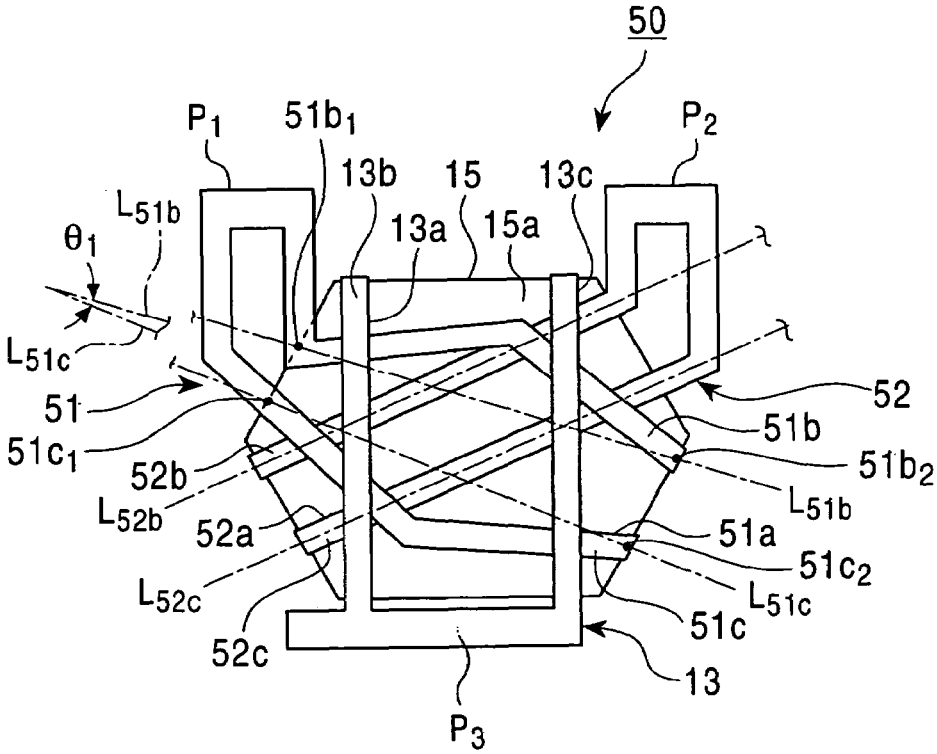
FIG. 7 is a schematic plan view showing the main section of an isolator as an example of a nonreciprocal circuit element according to a fourth embodiment of the present invention.

A fourth embodiment of the present invention will now be described with reference to the drawings. FIG. 7 is a schematic plan view of the main section of an isolator according to this embodiment. In this embodiment, the two divisions of a first central conductor extend so as to diverge from the common electrode to a halfway point and so as to converge from the halfway point towards the port, and the angle $\theta_2$ between the two divisions of a second central conductor is 0°. The reference numerals and symbols in FIG. 7 refer to the same components as those with the same reference numerals and symbols in FIG. 1, and repeated descriptions of the same components are omitted or provided only briefly.

Referring to FIG. 7, a magnetic assembly 50 of an isolator according to this embodiment includes a magnetic plate 15; a common electrode (not shown) disposed on the bottom surface of the magnetic plate 15; and first, second, and third central conductors 51, 52, and 13 protruding in three directions from the common electrode and being wrapped towards a top surface 15*a* of the magnetic plate 15.

The positional relationship among the three central conductors at their intersection is as with the first embodiment. That is, the first central conductor 51 is farther away from the magnetic plate 15 than the second central conductor 52.

As shown in FIG. 7, the first central conductor 51, the second central conductor 52, and the third central conductor 13 are provided with a slit 51*a*, a slit 52*a*, and a slit 13*a*, respectively. Each of the three central conductors 51, 52, and 13 includes two conductor divisions generated by the corresponding slit. More specifically, the first central conductor 51 includes two divisions 51*b* and 51*c*, the second central conductor 52 includes two divisions 52*b* and 52*c*, and the third central conductor 13 includes two divisions 13*b* and 13*c*. The divisions 51*b*, 51*c*, 52*b*, 52*c*, 13*b*, and 13*c* are substantially linear conductors extending, with a constant width maintained, along the longitudinal direction of the respective central conductors 51, 52, and 13.

As shown in FIG. 7, the divisions 51*b* and 51*c* of the first central conductor 51 on the top surface 15*a* of the magnetic plate 15 extend such that the slit 51*a* between the divisions 51*b* and 51*c* becomes wider from the common electrode to a halfway point and, from the halfway point, the slit 51*a* becomes narrower towards the port $P_1$. In other words, an imaginary center line $L_{51b}$ for the division 51*b* and an imaginary center line $L_{51c}$ for the division 51*c* are not parallel to each other. Hence, the imaginary center lines $L_{51b}$ and $L_{51c}$ cross each other at an angle $\theta_1$.

The imaginary center line $L_{51b}$ is defined as a line connecting the centers in the width direction at both extremities of the division 51*b* so as to extend along the longitudinal direction of the division 51*b*. The imaginary center line $L_{51c}$ is defined in the same manner in relation to the division 51*c*. Here, an extremity of a division of a central conductor is defined as a longitudinal end of the segment of the division, i.e., the segment overlapping the top surface 15*a* of the magnetic plate 15. In short, the imaginary center lines $L_{51b}$ and $L_{51c}$ are as shown in FIG. 7, where the divisions 51*b* and 51*c* according to this embodiment are substantially linear conductors with a constant width along the longitudinal direction, and extend so as to diverge up to a halfway point and, from the halfway point extend so as to converge towards the port 1.

As a result, the imaginary center line $L_{51b}$ is defined as a line connecting points 51$b_1$ and 51$b_2$, as shown in FIG. 7, where the points 51$b_1$ and 51$b_2$ are respectively the centers in the width direction at both longitudinal extremities of the division 51*b*. The imaginary center line $L_{51c}$ is defined as a line connecting points 51$c_1$ and 51$c_2$ in the same manner in relation to the division 51*c*.

In contrast, the divisions 52*b* and 52*c* extend such that the width of the slit 52*a* between the divisions 52*b* and 52*c* is constant from the common electrode towards the port $P_2$. In other words, an imaginary center line $L_{52b}$, which is a longitudinal center line of the division 52*b*, and an imaginary center line $L_{52c}$, which is a longitudinal center line of the division 52*c*, are parallel to each other. Hence, the imaginary center lines $L_{52b}$ and $L_{52c}$ do not cross each other, that is, $\theta_2$ is 0° in this embodiment of the present invention.

As a result, in this embodiment, the relationship between $\theta_1$ for the first central conductor 51 and $\theta_2$ for the second central conductor 52 is represented by $\theta_1>\theta_2=0°$.

Here, the angle $\theta_1$ preferably ranges from 2° to 10°, and more preferably from 4° to 6°.

The isolator with the structure described above can offer the similar advantages to those of the isolators according to the second and third embodiments.

Fifth Embodiment

Figure 8:
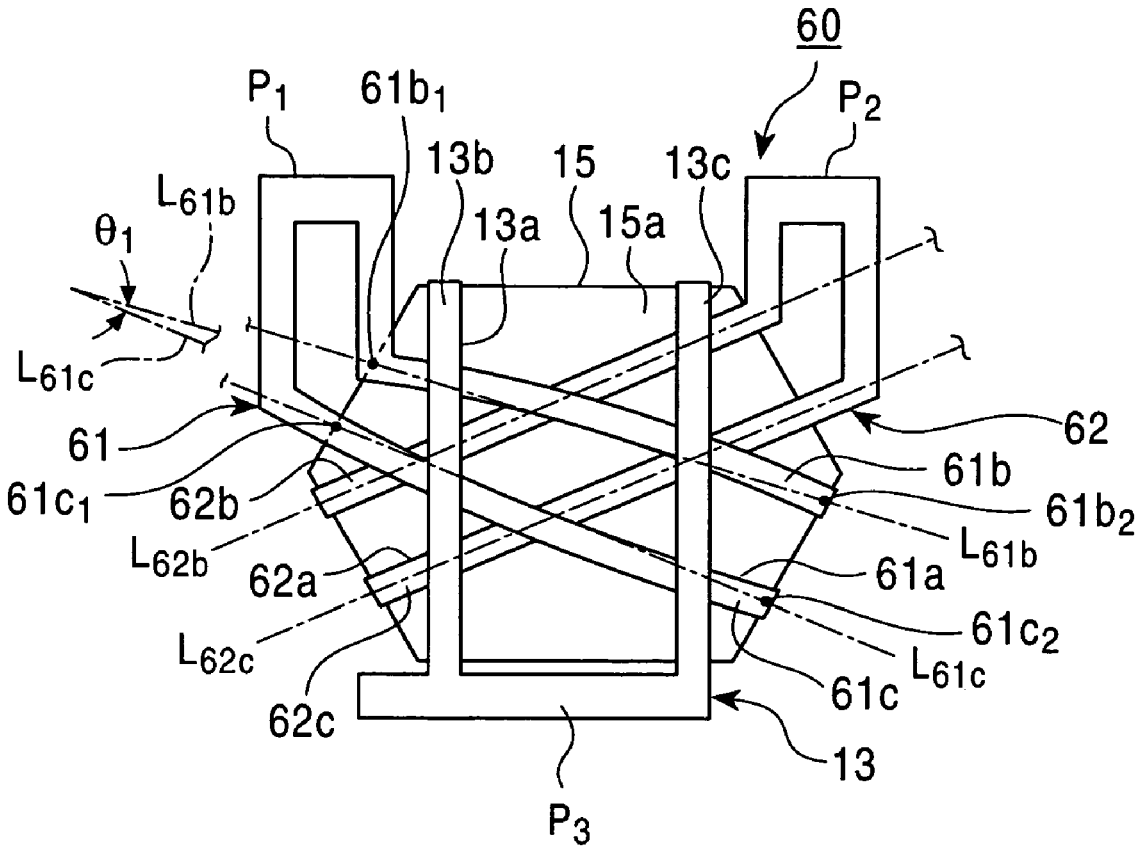
FIG. 8 is a schematic plan view showing the main section of an isolator as an example of a nonreciprocal circuit element according to a fifth embodiment of the present invention.

A fifth embodiment of the present invention will now be described with reference to the drawings. FIG. 8 is a schematic plan view of the main section of an isolator according to this embodiment. In this embodiment, the two divisions of a first central conductor are shaped like arcs and extend so as to converge towards the port, and the angle $\theta_2$ between the two divisions of a second central conductor is 0°. The reference numerals and symbols in FIG. 8 refer to the same components as those with the same reference numerals and symbols in FIG. 1, and repeated descriptions of the same components are omitted or provided only briefly.

Referring to FIG. 8, a magnetic assembly 60 of an isolator according to this embodiment includes a magnetic plate 15; a common electrode (not shown) disposed on the bottom surface of the magnetic plate 15; and first, second, and third central conductors 61, 62, and 13 protruding in three directions from the common electrode and being wrapped towards a top surface 15*a* of the magnetic plate 15.

The positional relationship among the three central conductors at their intersection is as with the first embodiment. That is, the first central conductor 61 is farther away from the magnetic plate 15 than the second central conductor 62.

As shown in FIG. 8, the first central conductor 61, the second central conductor 62, and the third central conductor 13 are provided with a slit 61*a*, a slit 62*a*, and a slit 13*a*, respectively. Each of the three central conductors 61, 62, and 13 includes two conductor divisions generated by the corresponding slit. More specifically, the first central conductor 61 includes two divisions 61*b* and 61*c*, the second central conductor 62 includes two divisions 62*b* and 62*c*, and the third central conductor 13 includes two divisions 13*b* and 13*c*. The divisions 61*b*, 61*c*, 62*b*, 62*c*, 13*b*, and 13*c* are substantially linear or curved conductors extending, with a constant width maintained, along the longitudinal direction of the respective central conductors 61, 62, and 13.

As shown in FIG. 8, the segments of the divisions 61*b* and 61*c* of the first central conductor 61 on the top surface 15*a* of the magnetic plate 15 are shaped like arcs in plan view, and extend such that the slit 61*a* between the divisions 61*b* and 61*c* becomes narrower towards the port $P_1$. In other words, an imaginary center line $L_{61b}$ for the division 61*b* and an imaginary center line $L_{61c}$ for the division 61*c* are not parallel to each other. Hence, the imaginary center lines $L_{61b}$ and $L_{61c}$ cross each other at an angle $\theta_1$.

The imaginary center line $L_{61b}$ is defined as a line connecting the centers in the width direction at both extremities of the division 61*b* so as to extend along the longitudinal direction of the division 61*b*. The imaginary center line $L_{61c}$ is defined in the same manner in relation to the division 61*c*. Here, an extremity of a division of a central conductor is defined as a longitudinal end of the segment of the division, i.e., the segment overlapping the top surface 15*a* of the magnetic plate 15. In short, the imaginary center lines $L_{61b}$ and $L_{61c}$ are as shown in FIG. 8, where the divisions 61*b* and 61*c* according to this embodiment are substantially arc conductors in plan view with a constant width along the longitudinal direction, and extend so as to converge towards the port 1.

As a result, the imaginary center line $L_{61b}$ is defined as a line connecting points 61*b*$_1$ and 61*b*$_2$, as shown in FIG. 8, where the points 61*b*$_1$ and 61*b*$_2$ are respectively the centers in the width direction at both longitudinal extremities of the division 61*b*. The imaginary center line $L_{61c}$ is defined as a line connecting points 61*c*$_1$ and 61*c*$_2$ in the same manner in relation to the division 61*c*.

In contrast, the divisions 62*b* and 62*c* extend such that the width of the slit 62*a* between the divisions 62*b* and 62*c* is constant from the common electrode towards the port $P_2$. In other words, an imaginary center line $L_{62b}$, which is a longitudinal center line of the division 62*b*, and an imaginary center line $L_{62c}$, which is a longitudinal center line of the division 62*c*, are parallel to each other. Hence, the imaginary center lines $L_{62b}$ and $L_{62c}$ do not cross each other, that is, $\theta_2$ is 0° in this embodiment of the present invention.

As a result, in this embodiment, the relationship between $\theta_1$ for the first central conductor 61 and $\theta_2$ for the second central conductor 62 is represented by $\theta_1>\theta_2=0°$.

Here, the angle $\theta_1$ preferably ranges from 2° to 10°, and more preferably from 4° to 6°.

The isolator with the structure described above can offer the similar advantages to those of the isolators according to the second, third, and fourth embodiments.

EXAMPLES

Isolator According to EXAMPLE 1

The characteristic impedance, isolation value, and insertion loss of an isolator with the same structure as the isolator according to the second embodiment in FIG. 5 were measured.

The isolator included a magnetic plate in the form of a substantially hexagonal plate made of yttrium iron garnet ferrite (YIG ferrite) 1.8 mm in long side, 1.5 mm in short side, and 0.35 mm in thickness. A first, second, and third central conductors were copper foils 1.6 mm in length, 0.15 mm in effective width, and 0.04 mm in thickness. The widths of the divisions of each central conductor were 0.15 mm, and the widths of the slits of the central conductors ranged from about 0.2 mm to 0.25 mm. These three central conductors extended in three directions from a substantially hexagonal common electrode.

Angle $\theta_1$ between the divisions of the first central conductor was 7°, and angle $\theta_2$ between the divisions of the second central conductor was 0°.

The common electrode was disposed on the bottom surface of the magnetic plate and the first, second, and third central conductors were folded towards the top surface of the magnetic plate to produce a magnetic assembly as shown in FIG. 5.

Next, a capacitor $C_1$ was mounted on a port $P_1$, which was at the end of the first central conductor, a capacitor $C_2$ was mounted on a port $P_2$, which was at the end of the second central conductor, and capacitor $C_3$ was mounted on a port $P_3$, which was at the end of the third central conductor. Furthermore, a terminating resistor R was mounted on the capacitor $C_3$. Then, the magnetic assembly with a permanent magnet attached on the magnetic plate was placed in a closed magnetic circuit composed of a top yoke component and a bottom yoke component to produce the isolator used in EXAMPLE 1.

In this isolator, the capacitance of the capacitor $C_1$ was 5.1 pF, the capacitance of the capacitor $C_2$ was 5.1 pF, the capacitance of the capacitor $C_3$ was 12.0 pF, and the resistance of the terminating resistor R was 120 Ω. The isolator was designed to have a characteristic impedance of 50 Ω and a center frequency of 1.88 GHz for isolation value.

Isolator According to COMPARATIVE EXAMPLE 1

An isolator same as the isolator according to EXAMPLE 1 was produced, with the exception of the angle $\theta_1$ between the divisions of the first central conductor being 0°. The isolator for COMPARATIVE EXAMPLE 1 was also designed to have a characteristic impedance of 50 Ω and a center frequency of 1.88 GHz for isolation value.

Figure 9:
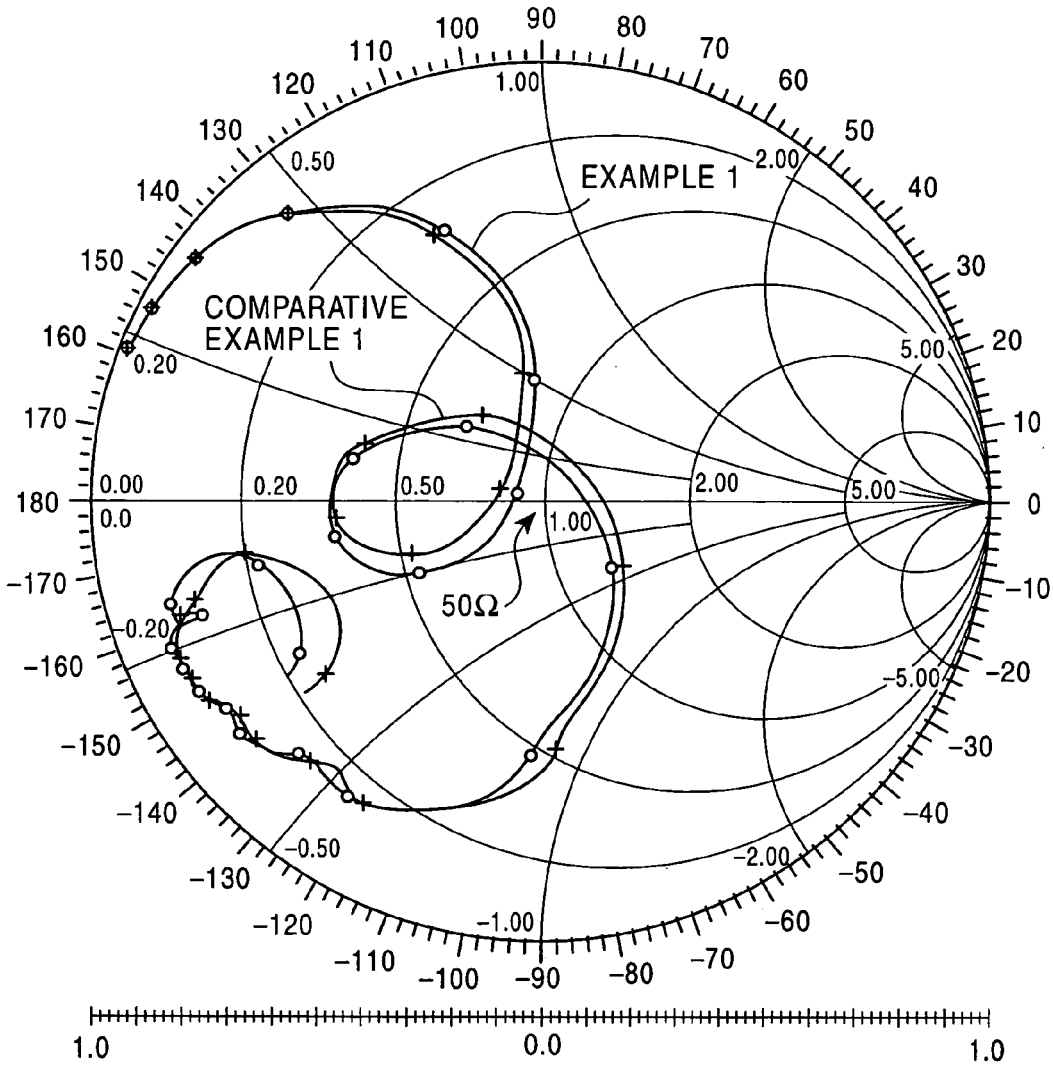
FIG. 9 is a Smith chart for isolators according to EXAMPLE 1 and COMPARATIVE EXAMPLE 1.
Figure 10:
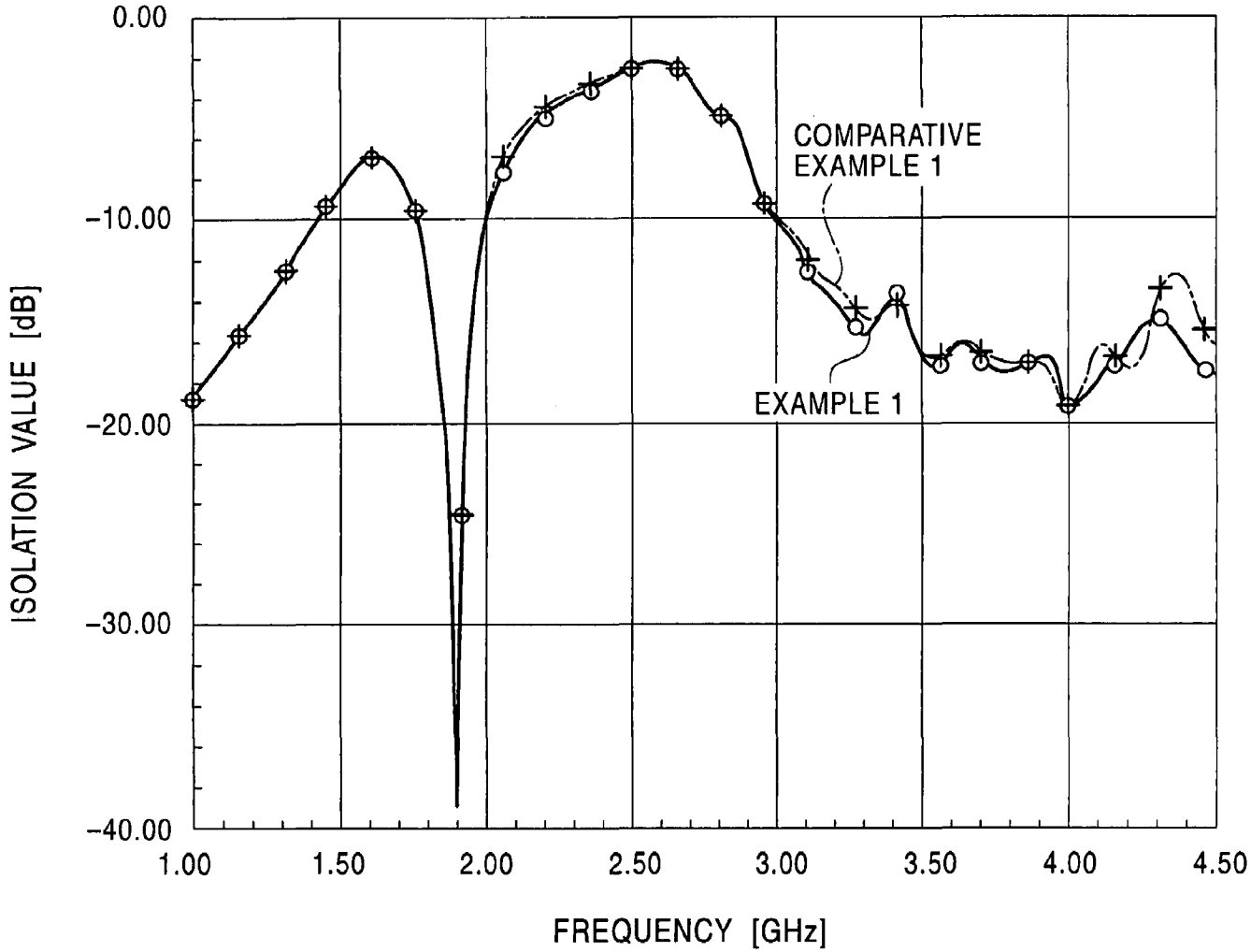
FIG. 10 is a graph showing a relationship between frequency and isolation of isolators according to EXAMPLE 1 and COMPARATIVE EXAMPLE 1.
Figure 11:
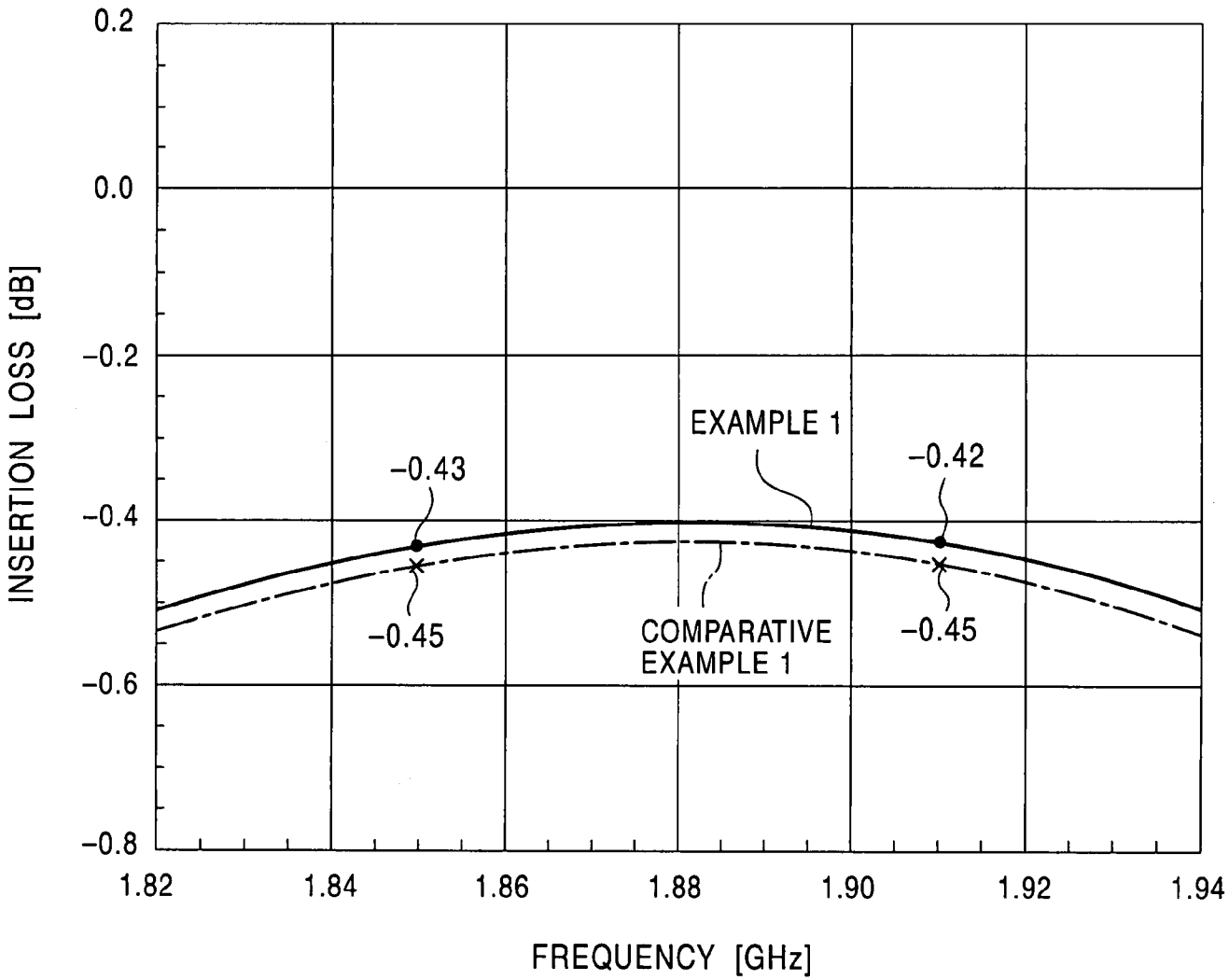
FIG. 11 is a graph showing a relationship between insertion loss and frequency of isolators according to EXAMPLE 1 and COMPARATIVE EXAMPLE 1.

The characteristics impedance, isolation value, and insertion loss of each of the isolators for EXAMPLE 1 and COMPARATIVE EXAMPLE 1 were measured. FIGS. 9 to 11 show the results.

FIG. 9 is a Smith chart showing a relationship between the reflection coefficient and the characteristic impedance of each of the isolator according to EXAMPLE 1 and the isolator according to COMPARATIVE EXAMPLE 1.

In FIG. 9, compared with the isolator according to COMPARATIVE EXAMPLE 1, the curve of the isolator according to EXAMPLE 1 was closer to 50 Ω at the circled portions. This means that the isolator according to EXAMPLE 1 exhibited a characteristic impedance more faithfully representing the design value. This is because the divisions of the first central conductor of the isolator according to EXAMPLE 1 were made so as to converge.

FIG. 10 shows the frequency characteristics of isolation. Table 1 shows the isolation values at frequencies of 1.85 GHz and 1.91 GHz. As shown in FIG. 10 and Table 1, the isolator according to EXAMPLE 1 and the isolator according to COMPARATIVE EXAMPLE 1 exhibited almost the same isolation characteristics at the center frequency and its surroundings (1.85 to 1.91 GHz). This means that the isolation characteristics of the isolator according to EXAMPLE 1, where the divisions of the first central conductor were made to converge, were not degraded.

TABLE 1

| | Frequency (GHz) | Isolation Value (dB) |
|---|---|---|
| EXAMPLE 1 | 1.85 | −20.44 |
| EXAMPLE 1 | 1.91 | −21.02 |
| COMPARATIVE EXAMPLE 1 | 1.85 | −21.87 |
| COMPARATIVE EXAMPLE 1 | 1.91 | −20.82 |

FIG. 11 shows the frequency characteristics of insertion loss. The isolator according to EXAMPLE 1 exhibited superior frequency characteristics because it had less insertion loss than the isolator according to COMPARATIVE EXAMPLE 1 at the center frequency and its surroundings (1.85 to 1.91 GHz).

From the results of FIGS. 10 and 11, it follows that the isolator according to EXAMPLE 1 reduces insertion loss without degrading the isolation characteristics.

What is claimed is:

1. A nonreciprocal circuit element comprising:

an input terminal;

an output terminal;

a magnetic plate;

a common electrode disposed on a first surface of the magnetic plate; and a first central conductor, a second central conductor, and a third central conductor each including a pair of divisions, the three central conductors extending from a circumference of the common electrode in three different directions, being bent along a circumference of the magnetic plate towards a second surface of the magnetic plate, and crossing one another on the second surface of the magnetic plate at a predetermined angle relative to one another, and the first and second central conductors being connected to the input and output terminals, wherein $\theta_1 > \theta_2$, where $\theta_1$ is an angle between the pair of divisions of the first central conductor and $\theta_2$ is an angle between the pair of divisions of the second central conductor, the first central conductor being farther away from the magnetic plate than the second central conductor.

2. The nonreciprocal circuit element according to claim 1, wherein the angle $\theta_2$ is 0°.

* * * * *